US005619929A

United States Patent [19]

Theurer

[11] Patent Number: 5,619,929

[45] **Date of Patent: *Apr. 15, 1997**

[54] TRACK TAMPING MACHINE, MACHINE ARRANGEMENT AND METHOD

[75] Inventor: Josef Theurer, Vienna, Austria

[73] Assignee: Franz Plasser Bahnbaumaschinen-Industriegesellschaft m.b.H., Vienna, Austria

[ * ] Notice: The term of this patent shall not extend beyond the expiration date of Pat. No. 5,617,793.

[21] Appl. No.: 604,662

[22] Filed: Feb. 21, 1996

[30] Foreign Application Priority Data

Mar. 7, 1995 [AT] Austria ..... 397/95

[51] Int. Cl.[6] ..... E01B 27/17

[52] U.S. Cl. ..... 104/12; 104/2; 104/7.2

[58] Field of Search ..... 104/2, 7.1, 7.2, 104/8, 12

[56] References Cited

U.S. PATENT DOCUMENTS

| | | | |
|---|---|---|---|
| 3,380,395 | 4/1968 | Plasser et al. | 104/12 |
| 3,494,297 | 2/1970 | Plasser et al. | 104/7.2 |
| 3,595,170 | 7/1971 | Plasser et al. | 104/12 |
| 3,744,428 | 7/1973 | Plasser et al. | 104/12 |
| 4,090,451 | 5/1978 | Theurer | 104/12 |
| 4,224,874 | 9/1980 | Theurer | 104/12 |
| 4,881,467 | 11/1989 | Theurer | 104/12 |
| 5,379,700 | 1/1995 | Theurer | 104/12 |

*Primary Examiner*—S. Joseph Morano
*Attorney, Agent, or Firm*—Collard & Roe, P.C.

[57] ABSTRACT

A mobile track tamping machine for simultaneously tamping ballast under a plurality of track ties comprises a machine frame extending in a longitudinal direction and supported by undercarriages on the track for movement in an operating direction. Two tamping tool assemblies are sequentially arranged in the longitudinal direction, each tamping tool assembly being capable of simultaneously tamping ballast under at least two track ties and comprising two tamping tools adjacent each other in the longitudinal direction and reciprocable from an initial position to a tamping position, the two tamping tools defining the distance between the track ties in the initial position. A reciprocating drive is connected to the two tamping tools, and the tamping tools of the two tamping tool assemblies adjacent each other in the longitudinal direction are spaced a distance corresponding to the distance between the track ties. The machine further comprises a track lifting and lining unit, and a reference system for controlling a correction of the position of the track.

22 Claims, 2 Drawing Sheets

TRACK TAMPING MACHINE, MACHINE ARRANGEMENT AND METHOD

BACKGROUND OF THE INVENTION

1. Field of the Invention

The present invention relates to a mobile track tamping machine for simultaneously tamping ballast under a plurality of track ties defining a distance between them and fastened to rails of the track, which comprises a machine frame extending in a longitudinal direction and supported by undercarriages on the track for movement in an operating direction, two tamping tool assemblies sequentially arranged in the longitudinal direction, each tamping tool assembly being capable of simultaneously tamping ballast under at least two track ties and comprising two tamping tools adjacent each other in the longitudinal direction and reciprocable in this direction from an initial position to a tamping position, the two tamping tools defining the distance between the track ties in the initial position, and a reciprocating drive connected to the two tamping tools. The machine further comprises a track lifting and lining unit, and a reference system controlling a correction of the position of the track. This invention further relates to a machine arrangement incorporating such a machine and to a tamping method.

2. Description of the Prior Art

A two-machine arrangement for track tamping in switches has been disclosed in U.S. Pat. No. 5,379,700. It comprises a first machine with a tamping tool assembly capable of simultaneously tamping ballast under a plurality of ties, and an auxiliary machine which may be coupled to the first machine and carries a tamping tool assembly capable of tamping a single tie. Before the tamping operation in a switch is started, the self-propelled auxiliary machine is uncoupled. Those ties in the main track and the branch track where the tamping tools may be readily immersed in the ballast are then tamped with the first machine while the ties that could not be readily tamped with the first machine are tamped with the auxiliary machine without lifting of the track. This permits efficient tamping of switches.

U.S. Pat. No. 3,744,428 discloses a two-machine arrangement wherein each track tamping machine carries a tamping tool assembly capable of simultaneously tamping ballast under two sequentially arranged ties. The rearward tamping tool assembly is displaceable in the longitudinal direction. In a first operating stage, two adjacent ties are simultaneously tamped by the leading tamping tool assembly, and the entire machine arrangement is then advanced by four ties by skipping two ties. The two skipped ties are then tamped by the rear tamping tool assembly. In an embodiment shown in FIG. 7 of the patent, both track tamping machines carry tamping tool assemblies capable of tamping only a single tie, and these assemblies are spaced a distance corresponding to the distance between two ties, i.e. a crib width. To compensate for differences in crib widths, the tamping tool assemblies are mounted for displacement in a longitudinal direction.

Track tamping machines with two tamping tool assemblies capable of simultaneously tamping more than one tie are also disclosed in U.S. Pat. Nos. 3,494,297, 3,595,170 and 4,224,874.

SUMMARY OF THE INVENTION

It is the primary object of this invention to provide a track tamping machine of the first-described type, which combines an accurate and long-lasting track positioning with a very high tamping productivity.

The above and other objects are accomplished according to the invention with such a track tamping machine wherein the tamping tools of the two tamping tool assemblies adjacent each other in the longitudinal direction are spaced a distance corresponding to the distance between the track ties.

This arrangement makes it possible to use time-tested tamping tool assemblies without structural changes to obtain substantially enhanced productivity in obtaining accurate and long-lasting track positioning. The spacing of the two tamping tool assemblies from each other provides an ideal solution because, on the one hand, it is not close enough to lead to structural problems and interference of the tamping tools with each other during the tamping operation and, on the other hand, it does not result in problematic track positioning due to large distances between the tamping tool assemblies. Since the track lifted and lined by the track lifting and lining unit to assume the desired track position is fixed in position by the simultaneous tamping of at least four ties, the accuracy of the positioning is assured despite the skipped center tie in the groups of simultaneously tamped ties, which is subsequently tamped. An auxiliary track tamping machine used for tamping this skipped tie can be very simply constructed since it requires only a tamping tool assembly capable of tamping a single tie, without further operating devices.

For this purpose, the invention provides a machine arrangement for tamping ballast under a plurality of track ties fastened to rails of the track, which comprises the above-described track tamping machine, a further self-propelled auxiliary track tamping machine, the auxiliary track tamping machine comprising a vertically adjustable tamping tool assembly capable of tamping ballast under a single tie, and a coupling linking the track tamping machines for common movement along the track.

This has the advantage that existing small tampers may be used as the auxiliary track tamping machine. Furthermore, since the two machines are self-propelled and may be moved along the track independently of each other, the high efficiency of the first track tamping machine may be optimally utilized without regard to the operation of the auxiliary tamping machine.

Finally, the present invention also relates to a method of sequentially tamping ballast under track ties with a track tamping machine advancing along the track in an operating direction, which comprises successive operating cycles in track sections comprising at least five sequentially arranged track ties, each operating cycle comprising a first operation wherein ballast is simultaneously tamped under two groups of track ties respectively preceding and succeeding a central track tie in the operating direction while correcting the track position, and a subsequent operation wherein the ballast is tamped under the central track tie.

The two-step operation provides a very high tamping productivity, the tamping under the central track tie skipped in the first operation being limited to a minimum to avoid disturbing the corrected track position obtained in the first operation. It is advantageous in this connection that the centered position of the skipped tie between two tamped ties assures a secure positioning of the track in the first operation.

BRIEF DESCRIPTION OF THE DRAWING

The above and other objects, advantages and features of this invention will become more apparent from the following detailed description of certain now preferred embodiments thereof, taken in conjunction with the accompanying, somewhat schematic drawing wherein.

DETAILED DESCRIPTION OF PREFERRED EMBODIMENTS

Figures 1, 4, 5, 6, 7:
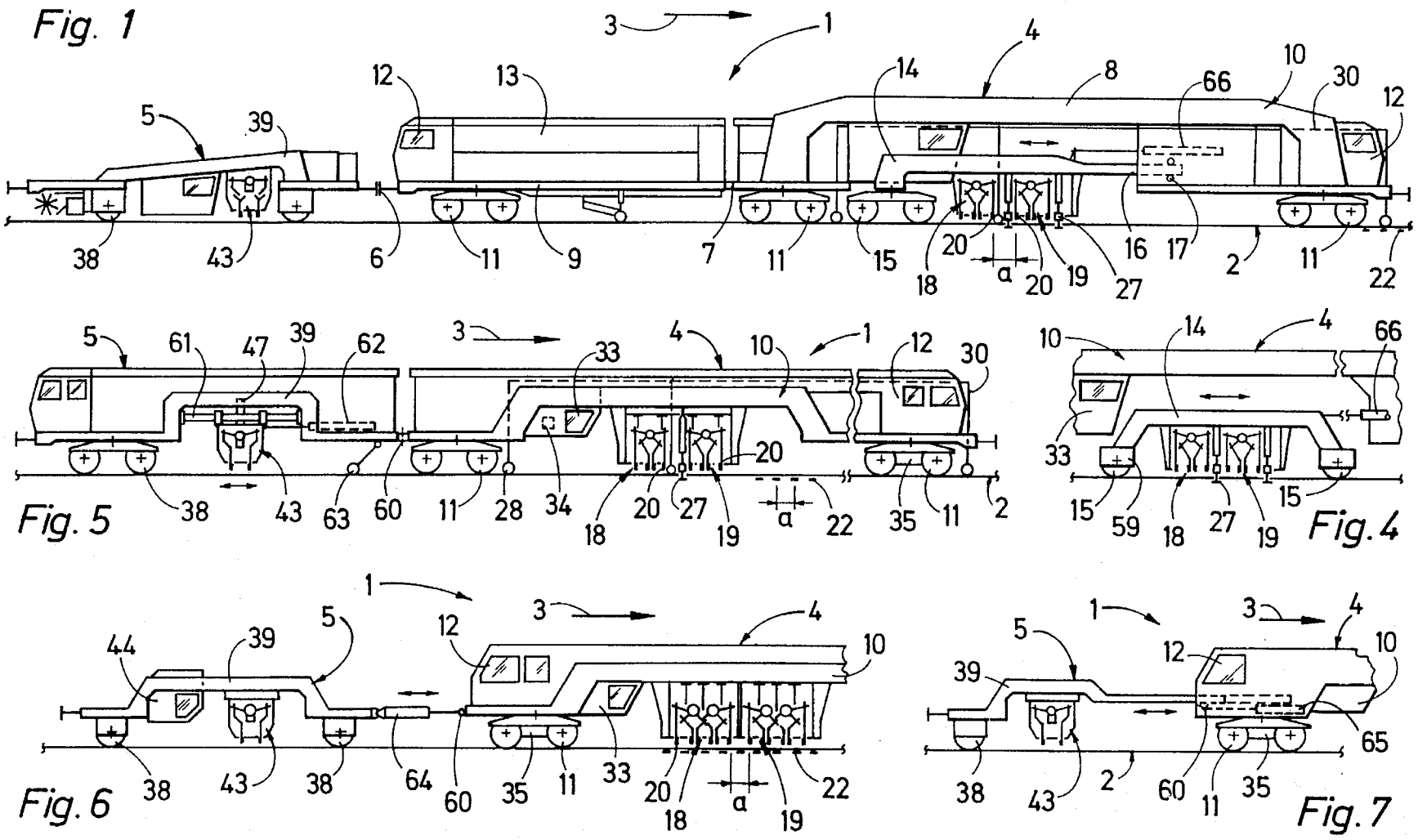
FIG. 1 is a side elevational view of a machine arrangement comprising a track tamping machine with two adjacent tamping tool assemblies preceding, in an operating direction, an auxiliary track tamping machine.
FIG. 4 is a fragmentary side elevational view illustrating an alternative embodiment of a carrier frame for the two tamping tool assemblies.
FIG. 5 is a side elevational view similar to FIG. 1, showing another embodiment in which the auxiliary track tamping machine is a trailer.
FIG. 6 is a like view showing a further embodiment in which the machines are connected by a longitudinal displacement drive.
FIG. 7 is a like fragmentary view showing yet another embodiment.

Referring now to the drawing and first to FIG. 1, there is shown machine arrangement 1 for simultaneously tamping ballast under a plurality of track ties 22 defining a distance a therebetween and fastened to rails of track 2. The machine arrangement comprises mobile track tamping machine 4 and auxiliary track tamping machine 5 trailing in an operating direction indicated by arrow 3. The two machines are detachably linked together by coupling 6.

Mobile track tamping machine 4 comprises a two-part machine frame 10 extending in a longitudinal direction and supported by undercarriages 11 on track 2 for movement in an operating direction, machine frame parts 8 and 9 being linked together at joint 7, and operator's cabs 12 being mounted at the leading and trailing ends of the machine frame. Power plant 13 is carried on trailing machine frame part 9 for providing energy to the operating drives of the machine. Two tamping tool assemblies 18, 19 are sequentially arranged on machine frame 10 in the longitudinal direction at each side thereof and associated with each rail, each tamping tool assembly being capable of simultaneously tamping ballast under at least two track ties 22. In the illustrated embodiment, a common carrier frame 14 supports the two tamping tool assemblies 18, 19 and extends in the longitudinal direction, undercarriage 15 supporting a rear end of carrier frame 14, in the operating direction, directly on track 2, and displacement drive 66 for displacing the carrier frame in the longitudinal direction connects front end 16 of the carrier frame, in the operating direction, to machine frame 10. Front carrier frame end 16 is longitudinally displaceably mounted in bearing 17 in the machine frame.

Figure 2:
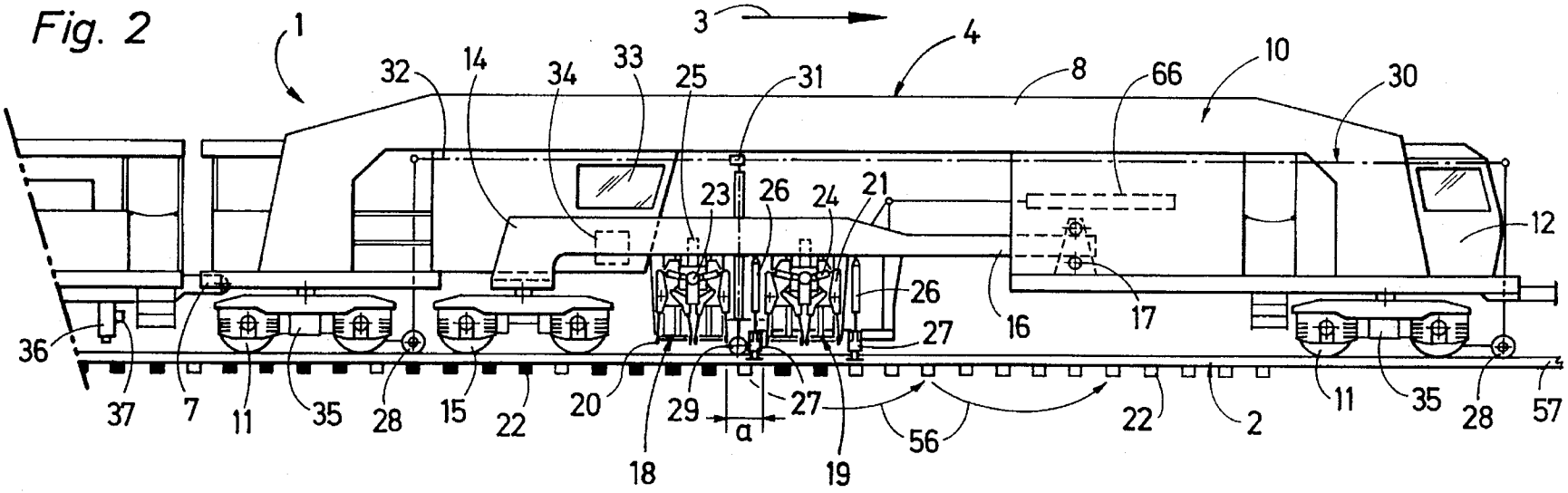
FIGS. 2 and 3 are enlarged side elevational views showing, respectively, a leading and a trailing section of the machine arrangement of FIG. 1.

As is particularly apparent from enlarged FIG. 2, each tamping tool assembly 18, 19 comprises two pairs of tamping arms 21 equipped with tamping tools 20. The two tamping tools 20 of each pair adjacent each other in the longitudinal direction are reciprocable in the longitudinal direction from an initial position to a tamping position, the two tamping tools defining the distance a between track ties 22 in the initial position. Reciprocating drive 24 is connected to the two tamping tools for moving the tamping tools from the initial to the tamping position. According to the invention, tamping tools 20 of the two tamping tool assemblies 18, 19 adjacent each other in the longitudinal direction are spaced a distance a corresponding to the distance between track ties 22 in the initial position. Drives 25 are Connected to the tamping tool assemblies for vertically adjusting the same for immersing the tamping tools in the ballast.

A vertically and laterally adjustable track lifting and lining unit 27 is mounted on carrier frame 14, and reference system 30 controls a correction of the position of the track by this unit. A unit 27 is arranged between the two tamping tool assemblies 18, 19 and, in the embodiment of FIGS. 1 and 2, a further track lifting and lining unit 27 immediately precedes a leading one of the tamping tool assemblies in the operating direction.

Reference system 30 comprises reference line 32, and sensing rollers 28 running on track 2 between the two tamping tool assemblies 18, 19 and supporting measuring sensor 31 in contact with the reference line, the measuring sensor being carried by a vertically adjustable element 29 on the sensing rollers. The reference line is a tensioned wire.

An operator's cab 33 cantilevered on machine frame 10 above undercarriage 15 of carrier frame 14 is equipped with central control panel 34 for actuating the operation of tamping tool assemblies 18, 19 and track lifting and lining units 27. Drive 35 continuously advances machine frame 10 along the track while intermittent tamping takes place by intermittently displacing carrier frame 14 relative to machine frame 10. To indicate tie 22 which is skipped when tamping tool assemblies 18, 19 simultaneously tamp four ties in a first operation, the machine comprises a marking device 36, for example a paint spraying device, for marking this track tie. The marking device comprises track tie sensing element 37 for automatically marking the selected tie.

Figure 3:
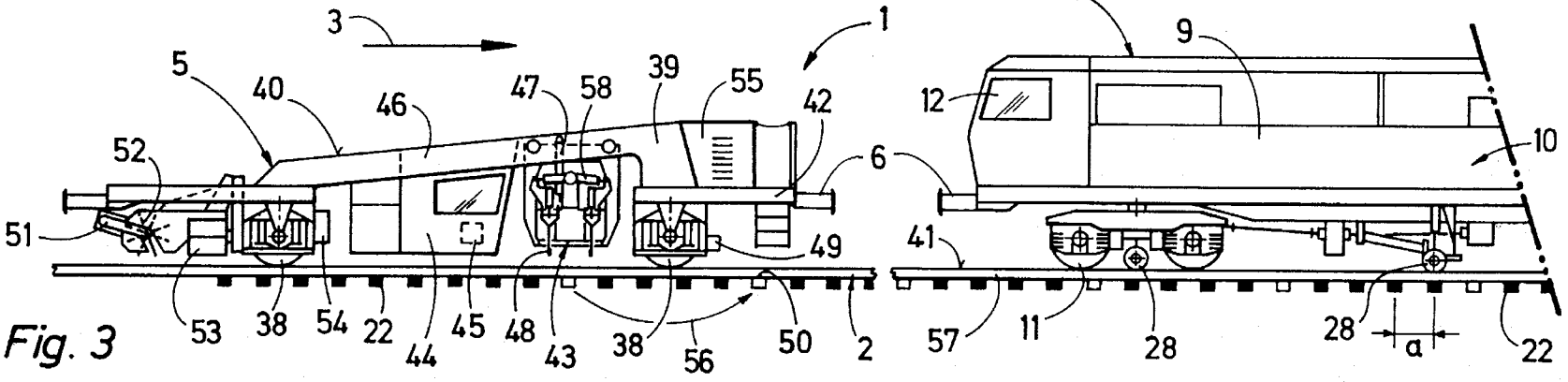

The track tamping machine 4 is combined with auxiliary track tamping machine 5 which, as best shown in FIG. 3, comprises machine frame 39 supported on track 2 by undercarriages 38 and having and end 42 linked to machine frame 10. Vertically adjustable tamping tool assembly 43 capable of tamping ballast under a single tie is mounted on machine frame 39, and drive 47 vertically adjusts the vertically adjustable tamping tool assembly. Tamping tool assembly 43 is comprised of a pair of reciprocable tamping tools 48 for tamping ballast under a single tie 22. The auxiliary track tamping machine comprises a detector 49 automatically detecting a marked track tie 50 and arranged to initiate actuation of vertically adjustable tamping tool assembly 43.

Track tamping machine 4 and auxiliary track tamping machine 5 comprise separate drive 35 and 54 for independently moving the machines along the track, and coupling 6 can link the machines together. Machine frame 39 of auxiliary track tamping machine 5 defines an inclined upper limiting plane 40 which is so dimensioned that a distance from an upper surface 41 of the rails to machine frame end 42 does not exceed 3.5 meters and to an opposite end of machine frame 39 does not exceed 2 meters. Vertically adjustable rotary brush 52 is mounted at the end of machine frame 39 of auxiliary track tamping machine 5 opposite end 42 linked to track tamping machine 4, and drive 51 rotates the brush. Transversely extending conveyor band 53 is arranged to receive the swept-up ballast from rotary brush 52 and to convey it to the track shoulder.

Two undercarriages 38, 38 support respective ends of machine frame 39 on track 2, and only vertically adjustable tamping tool assembly 43 and an operator's cab 44 are mounted on machine frame 39 between the two undercarriages. Machine frame 39 has upwardly recessed section 46 wherein the vertically adjustable tamping tool assembly and the operator's cab are arranged.

The operation of machine arrangement 1 proceeds as follows:

Auxiliary track tamping machine 5 is preferably coupled to track tamping machine 4 when machine arrangement 1 is moved to an operating site. When the operating site is reached, the auxiliary track tamping machine is uncoupled from track tamping machine 4 which precedes it in the operating direction. Drive 35 is then actuated to move machine frame 10 continuously along the track in the operating direction while carrier frame 14 with tamping tool assemblies 18, 19 is intermittently moved from tamping stage to tamping stage by actuating displacement drive 66. As soon as carrier frame 14 is stopped during a tamping stage, drives 25 are actuated to lower the tamping tool assemblies for immersion of tamping tools 20 in the ballast, and reciprocating drives 24 are operated to tamp the ballast simultaneously under the four ties positioned between the tamping tools of the two pairs of tools of tamping tool assemblies 18, 19 while skipping the tie lying centrally between the two groups of this being tamped. Immediately before this first tamping operation, any track position correction indicated as necessary by reference system 30 is effectuated under control of this system by track lifting and lining units 27. After the tamping operation has been completed, tamping tool assemblies are raised again and displacement drive 66 is operated to advance carrier frame 14 by five times distance a, as indicated by arrow 56. At this point, the tamping cycle of simultaneously tamping four ties is repeated.

When tamping tool assemblies 18, 19 are lowered, tie sensor 37, which preferably operates without contact with the ties, is activated to start counting the ties. As soon as skipped central tie 22 between the leading and trailing groups of tamped ties has come within the range of marking device 36, the marking device is automatically activated and this skipped central tie is sprayed with paint to form a marked tie 50. The marking device need not be a paint spraying device but marking may be effected, for example, by magnetizing the rail where it is fastened to the skipped central tie, or by any other marking means. The marking may also be effected directly between the two tamping tool assemblies.

As soon as the operator in cab 44 registers marked tie 50, trailing auxiliary track tamping machine 5 is stopped to center tamping tool assembly 43 associated with each rail 57 of track 2 over the marked tie. Drives 47 are actuated to immerse tamping tools 48 in the ballast and reciprocating drives 58 reciprocate the tamping tools to tamp ballast under the tie which was skipped in the first operation. Control 45 in cab 44 automatically stops the operation of reciprocating drive 58 when a pre-selected tamping pressure has been reached. Since no track correction is made during the second tamping operation, the accurate track positioning achieved during the first operation remains undisturbed. If desired, the advance of auxiliary track tamping machine 5 may be automatically halted when detector 49 registers marked tie 50.

In FIGS. 4–7, the same reference numerals are used to designate parts operating in a like manner.

Referring to FIG. 4, track tamping machine 4 differs from that of the previously described embodiment by a further undercarriage 15 supporting a front end of carrier frame 14, in the operating direction, directly on track 2. The relative displacement of the carrier frame is effected by displacement drive 66, which connects carrier frame 14 to machine frame 10, in cooperation with a drive 59 propelling the carrier frame.

As shown in FIG. 5, track tamping machine 4 is comprised of machine frames 10 and 39, joint 60 linking the machines frames to each other. Trailing machine frame 39 constitutes auxiliary track tamping machine 5 in this embodiment. Guide 61 displaceably supports vertically adjustable tamping tool assembly 43, the guide being mounted on machine frame 39 and extending horizontally in the longitudinal direction. Drive 62 is connected to vertically adjustable tamping tool assembly 43 for displacement thereof along guide 61. Also, in this embodiment, tamping tool assemblies 18, 19 are fixedly mounted directly on machine frame 10.

Machine arrangement 1 shown in FIG. 5 is intermittently moved from tamping stage to tamping stage, the machine arrangement being moved from stage to stage by five times the distance a between track ties 22. While four ties are simultaneously tamped by leading tamping tool assemblies 18, 19 in the manner previously described, trailing tamping tool assemblies 43 are operated in a parallel operation to tamp the central tie skipped by the preceding operation. Immediately before the parallel operation, tamping tool assemblies 43 are automatically centered over the skipped tie by operating displacement drive 62. For this purpose, the track tamping machine comprises control 34 in cab 33 for automatically actuating the vertical adjustment and displacement drives 47, 62, the control being connected to odometer 63 registering the length of the path of movement of the track tamping machine along the track, beginning automatically with the lowering of tamping tool assemblies 18, 19.

In the embodiment of FIG. 6, machine frames 10 and 39 of machine arrangement 1 are connected by displacement drive 64 for displacing joint 60 in the longitudinal direction. The displacement drive enables the distance between tamping tool assemblies 18, 19 and tamping tool assembly 43 to be slightly adjusted to center tamping tool assembly 43 over the tie to be tamped thereby. Each tamping tool assembly 18, 19 is equipped with three pairs of tamping tools 22 to enable them simultaneously to tamp three adjacent ties. Machine arrangement 1 is intermittently advanced from one tamping stage to the next by seven times the distance a. It would also be possible to use one tamping tool assembly capable of tamping two ties simultaneously and the other tamping tool assembly capable of simultaneously tamping three ties.

Finally, FIG. 7 shows machine arrangement 1 in which machine frame 39 of auxiliary track tamping machine 5 is a trailer longitudinally displaceably joined to a rear end of machine frame 10 by displacement drive 65.

What is claimed is:

1. A track working system comprising a machine arrangement riding on rails fastened to ties embedded in ballast and defining a distance therebetween, which comprises (a) a machine frame extending in a longitudinal direction and supported on undercarriages on the rails for movement in an operating direction, (b) two successive tamping tool assemblies spaced from each other in the longitudinal direction so that each respectively tamps the ballast under two successive ties of a pair of ties while leaving a single untamped central tie located between the respective pairs of ties being tamped by the two tamping assemblies, each tamping tool assembly comprising (1) two tamping tools adjacent each other in the longitudinal direction and reciprocable in said direction from an initial position to a tamping position, the two tamping tools defining the distance between the ties in the initial position, and the tamping tools of the two tamping tool assemblies adjacent each other being spaced a fixed distance corresponding to the distance between the ties, and (2) a reciprocating drive connected to the two tamping tools, (c) a track lifting and lining unit, and (d) a reference system for controlling a correction of the position of the track.

2. The track working system of claim 1, wherein the track lifting and lining unit is arranged between the two tamping tool assemblies.

3. The track working system of claim 2, comprising a further track lifting and lining unit immediately preceding a leading one of the tamping tool assemblies in the operating direction.

4. The track working system of claim 1, wherein the reference system comprises a reference line, and sensing rollers running on the track between the two tamping tool assemblies and supporting a measuring sensor in contact with the reference line.

5. The track working system of claim 1, further comprising a common carrier frame supporting the two tamping tool assemblies and extending in the longitudinal direction, an undercarriage supporting a rear end of the carrier frame, in the operating direction, directly one the track, and a displacement drive for displacing the carrier frame in the longitudinal direction, the displacement drive connecting a front end of the carrier frame, in the operating direction, to the machine frame.

6. The track working system of claim 5, comprising a further undercarriage supporting a front end of the carrier frame, in the operating direction, directly on the track.

7. The track working system of claim 1, combined with an auxiliary track tamping machine, the auxiliary track tamping machine comprising an auxiliary machine frame supported on the rails by auxiliary undercarriages and having an end linked to the first-named machine frame, a vertically adjustable auxiliary tamping tool assembly to tamp ballast under a single tie, and a drive for vertically adjusting the vertically adjustable auxiliary tamping tool assembly.

8. The track working system of claim 7, further comprising a joint linking the machine frames to each other.

9. The track working system of claim 8, further comprising a displacement drive for displacing the joint in the longitudinal direction.

10. The track working system of claim 7, further comprising a guide displaceably supporting the vertically adjustable auxiliary tamping tool assembly, the guide being mounted on the auxiliary machine frame and extending horizontally in the longitudinal direction, and a drive connected to the vertically adjustable tamping tool assembly for displacement thereof along the guide.

11. The track working system of claim 10, further comprising a control for automatically actuating the vertical adjustment and displacement drives, the control comprising an odometer registering the length of the path of movement of the machine arrangement along the track.

12. The track working system of claim 7, comprising a marking device for marking a selected track tie.

13. The track working system of claim 12, wherein the marking device comprises a track tie sensing element for automatically marking the selected tie.

14. The track working system of claim 12, wherein the auxiliary track working system comprises a detector automatically detecting the marked track tie and arranged to initiate actuation of the vertically adjustable auxiliary tamping tool assembly.

15. The track working system of claim 7, further comprising a separate drive for the track first named machine frame and the auxiliary track working system for independently moving the machines along the track, and a coupling for linking the machines.

16. The track working system of claim 7, wherein the auxiliary machine frame defines an upper limiting plane so dimensioned that a distance from an upper surface of the rails to said auxiliary machine frame end does not exceed 3.5 meters and to an opposite end of said auxiliary machine frame does not exceed 2 meters.

17. The track working system of claim 7, further comprising a rotary brush mounted at an end of the auxiliary machine frame opposite the end linked to the first-named machine frame.

18. The track working system of claim 7, wherein two of said auxiliary undercarriages support respective ends of the auxiliary machine frame on the track, only the vertically adjustable auxiliary tamping tool assembly and an operator's cab being mounted on said auxiliary machine frame between the two auxiliary undercarriages, said auxiliary machine frame having an upwardly recessed section wherein the vertically adjustable auxiliary tamping tool assembly and the operator's cab are arranged.

19. The track working system of claim 1 further comprising a self-propelled auxiliary track tamping machine, the auxiliary track tamping machine comprising a vertically adjustable auxiliary tamping tool assembly to tamp ballast under a single tie, and a coupling for linking the first-named machine frame to the auxiliary track working system for common movement along the track.

20. A method of sequentially tamping ballast under track ties with a track working system advancing along the track in an operating direction, which comprises successive operating cycles in track sections comprising at least five sequentially arranged track ties, each operating cycle comprising (a) a first operation wherein ballast is simultaneously tamped under two groups of track ties respectively preceding and succeeding a single central track tie in the operating direction while correcting the track position, and (b) a subsequent operation wherein the ballast is tamped under the single central track tie.

21. The ballast tamping method of claim 20, wherein the ballast tamping under the single central track tie is automatically controlled in response to a length of the advancement of the track tamping machine.

22. The ballast tamping method of claim 20, wherein the ballast tamping under the single central track tie is automatically terminated in response to a preselected tamping pressure.

* * * * *